United States Patent [19]

Warshawsky

[11] 4,449,169

[45] May 15, 1984

[54] VERTICAL SWING BRACKET

[76] Inventor: Jerome Warshawsky, 3284 Bertha Dr., Baldwin Harbor, N.Y. 11510

[21] Appl. No.: 434,611

[22] Filed: Oct. 15, 1982

[51] Int. Cl.[3] ..... F21S 1/12

[52] U.S. Cl. ..... 362/413; 362/238; 362/239; 362/250; 362/269; 362/285; 362/414; 362/418; 362/427; 362/431; 362/432

[58] Field of Search ..... 362/413, 427, 431, 432, 362/269, 285, 238, 239, 250, 414, 418

[56] References Cited

U.S. PATENT DOCUMENTS

| | | | |
|---|---|---|---|
| 2,280,402 | 4/1942 | Greppin | 362/432 |
| 2,488,898 | 11/1949 | Brasty | 362/413 |
| 3,983,386 | 9/1976 | Schallenkammer | 362/427 |
| 4,247,886 | 1/1981 | Warshawsky | 362/431 |
| 4,347,557 | 8/1982 | Warshawsky | 362/431 |

*Primary Examiner*—Stephen J. Lechert, Jr.
*Assistant Examiner*—Howard J. Locker
*Attorney, Agent, or Firm*—Stephen E. Feldman

[57] ABSTRACT

Each one of a pair of swing units, for mounting the swing arm assemblies of a swing arm lamp, is formed as a relatively short substantially tubular member having a tubular mounting end of reduced outside diameter and that is provided with a circumferential groove. The reduced end of each swing unit is received by a respective mounting seat of a vertical swing bracket which mounts both swing units for rotation about a pair of predetermined axis of rotation that are spaced and parallel one to the other. A pair of threaded bolt like members are carried by the swing bracket so that an end of each threaded member can be moved from a position wherein the end projects into its respective groove, to prevent unseating of the swing unit from the bracket, but not so as to prevent rotation thereon; to a position wherein said ends are removed from the respective grooves so that the swing units can be removed from the bracket. The swing units each receive an end of a tubular swing arm of a swing arm assembly along lines which are either perpendicular to said predetermined axis of rotation, or co-axial therewith.

17 Claims, 7 Drawing Figures

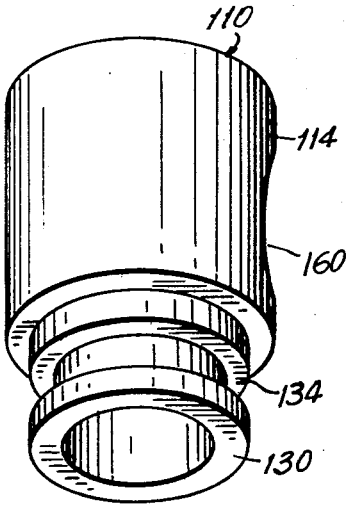
FIG. 4
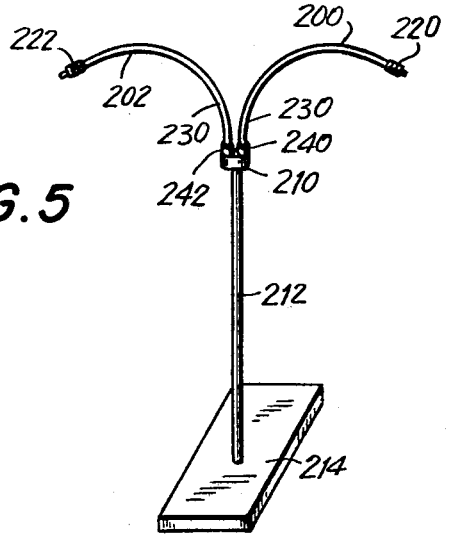
FIG. 5
FIG. 6
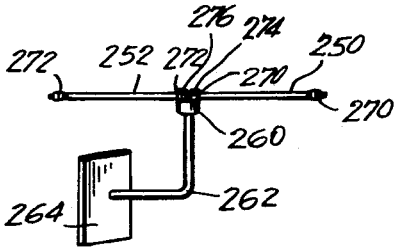
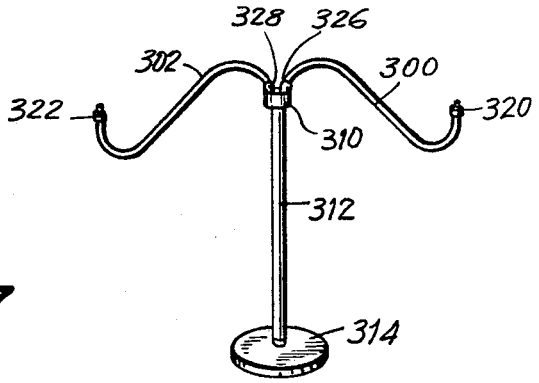
FIG. 7

VERTICAL SWING BRACKET

BACKGROUND OF THE INVENTION

1. Field of Application

This invention relates to lamps; and more particularly to vertical swing brackets and associated swing arm assemblies for lamps.

2. Description of the Prior Art

Wall, floor, and table lamps are in wide use to provide light in rooms, and other locations, where light fixtures and other forms of lighting have also been installed but do not provide adequate or appropriate light; and where the room design or aesthetics dictate the use of one or more lamps instead of light fixtures and/or other forms of lighting. Many lamps support the light source in one and only one position. If light is required outside the area that light from the single position lamp falls upon, then the user must either get another lamp or move the present lamp to a new location.

Obviously, wall mounted single position lamps are quite difficult to move, especially for temporary purposes. Table and floor lamps are more easily movable but only if there is the requisite table or floor space to receive the lamp. Connecting a moved single position lamp to a source of electricity may also prove bothersome because the electric cord may have to be placed across a path of movement, or furniture may be in the way, or because an electrical extension may be required where it was not needed before.

Other available lamps utilize swing arms to facilitate locating an otherwise single position lamp in many possible positions along the arc of travel of the swing arm. But, many such lamps have sometimes also proved unacceptable because they support only a single light source. Additionally, the available brackets for supporting the swing unit, to which the swing arm is attached so as to permit the required rotation of the lamp, have sometimes been too complex in construction and expensive in cost, and other times failed to properly support the swing unit with the attached swing arm assembly and lamp.

Aesthetic creativity in the appearance of swing arm lamps seems to have been restricted to the light source and its shade or cover, or in the materials, colors, and shapes of the swing arms and their support units. This seems to be so because there is not too much that can be done, creatively or aesthetically, with a swing arm that is restricted to a single unit, and at that, one which must extend out in a direction perpendicular to the axis of rotation about which the lamp swings.

SUMMARY OF THE INVENTION

It is therefore an object of this invention to provide a novel and improved vertical swing bracket for a swing arm lamp.

It is another object of this invention to provide a novel and improved vertical swing bracket and swing arm assembly for a swing arm lamp.

It is yet another object of this invention to provide a novel and improved swing arm lamp.

It is still another object of this invention to provide a novel and improved vertical swing bracket which mounts a pair of swing arms.

It is yet still another object of this invention to provide a novel and improved vertical swing bracket which mounts a pair of swing units for rotation about spaced vertically disposed axes of rotation.

It is a further object of this invention to provide a novel and improved vertical support bracket which supports one or more swing units and its attached swing arm and lamp.

This invention involves vertical swing brackets for swing arm lamps: and contemplates forming the vertical swing bracket to support, position and retain each swing unit, (to which a swing arm is to be connected) in such a manner that each swing unit rotates about a vertical axis of rotation, and all such vertical axes of rotation are disposed to be parallel, one with respect to the other.

Other objects, features, and advantages of the invention in its details of construction and arrangement of parts will be seen from the above, from the following description of the preferred embodiment when considered with the drawings and from the appended claims.

BRIEF DESCRIPTION OF THE DRAWING

In the drawing:

FIG. 4 is a perspective view of one of the swing units;

FIG. 5 is a schematic perspective view of a base mounted swing arm lamp with its swing arms mounted to extend vertically up from the swing units;

FIG. 6 is a perspective view of a wall mounted vertical support bracket for a swing arm lamp; and FIG. 7 is a perspective view of a base mounted vertical support bracket supporting modified swing units and swing arms.

DESCRIPTION OF THE PREFERRED EMBODIMENT

Figure 1:
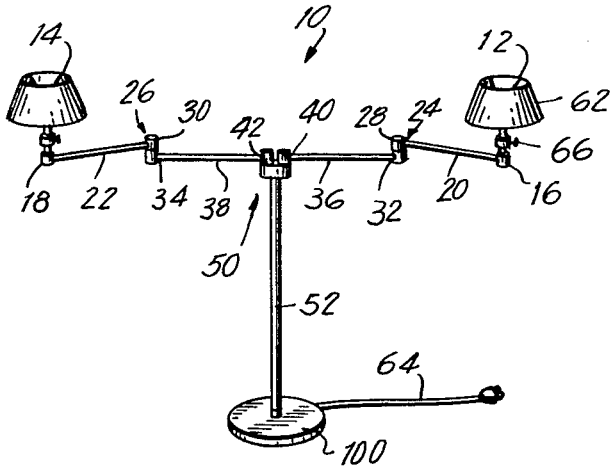
FIG. 1 is a perspective view of a base mounted swing arm lamp incorporating the instant invention.

With reference to FIG. 1, there is generally shown at 10 a swing arm lamp having a pair of light sources 12, 14 respectively carried at first ends 16, 18 of outboard swing arms 20, 22, the second ends 24, 26 of which are connected to and extend from swivel assemblies 28, 30. Swivel assemblies 28, 30 are otherwise carried by first ends 32, 34 of inboard swing arms 36, 38 the second ends 40, 42 of which are respectively connected to and extend from a vertical swing arm support bracket 50 adapted to be secured to a support post 52 or other vertically disposed member. Swing arms 20, 22, 36 and 38 are fabricated from tubular material such as pipe.

Outboard swing arm 20, swivel assembly 28 and inboard swing arm 36 constitute a first swing arm assembly; while outboard swing arm 22, swivel assembly 30 and inboard swing arm 38 constitute a second swing arm assembly. Since both swing arm assemblies are identical in construction only one will be described hereinafter in greater detail.

Outboard swing arm 20 has external threads (not shown) formed at its ends 16 and 24; and is connected to light source 12, and swivel assembly 24, by having such external threads threaded into internal threads (not shown) formed in appropriate openings of light source 12 and swivel assembly 24. Inboard swing arm 36 has external threads (not shown) formed at its ends 32, 40, and is connected to swivel assembly 24 by having the external threads at end 32 threaded into internal threads (not shown) formed in an appropriate opening of swivel assembly 24. The same procedure is followed to connect end 28 of inboard swing arm 36, to vertical swing bracket 50.

Light source 12 includes a socket 60, for receiving a suitable light bulb, and a shade 62 appropriately and conventionally mounted thereon. Suitable electrical conductor wire 64 extends from socket 60 through outboard swing arm 20, an opening (not shown) suitably formed in swivel assembly 24, through inboard swing arm 36 and out through swing bracket 50 as will be hereinafter explained. An appropriate male plug is provided at the end of conductor 64 to connect same, and light source 12 to a source of electricity. A switch 66 is provided on socket 60 to turn same on and off, and through intermediate positions if provided. Conductor 64 can also be connected directly to a junction box, and controlled by a remote switch if desired. Light source 14 is constructed and connected to conductor wire 64 in the same manner.

Vertical swing bracket 50 (FIGS. 1 and 2) includes a support body 70 of somewhat oval configuration with round semi-circular ends 72, 74 and parallel flat sides 76, 78. A pair of circular openings 80, 82 are formed in body 70 extending down from an upper surface 84 thereof and terminating at a lower wall 86 of body 70. A central wall 90, separating openings 80, 82 terminates short of lower wall 86 to provide a passageway 92 for conductor wire 64. A bottom opening 96, extending from passageway 92 out through lower wall 86, is provided with internal threads to receive external threads 98 on the upper end of support post 52; the other end of which is secured to a suitable base 100.

Upper surface 84 of body 70 as it surrounds openings 80, 82 forms, with the upper inner walls of openings 80, 82, mounting seats for swing units 110 (FIGS. 2–4) and 112 (FIGS. 2 and 4) which are formed from tubular stock. The outside diameter of swing units 110, 112 are substantially the same diameter as that of semi-circular ends 72, 74 of body 70; however swing units 110, 112 have side walls 114, 116 respectively that are thicker than walls 118, 120 of body 70. Each swing unit is formed with an end or seating portion 130, 132 respectively that is reduced in outside diameter from that of side walls 114, 116. A circumferential groove 134, 136 surrounds and is formed into end portions 130, 132 of swing units 110, 112.

Circular grooves 134, 136 are disposed and sized to receive ends 140, 142 respectively of threaded members 144, 146 when threaded members 144, 146 are fully seated in internally threaded openings 150, 152 respectively, of walls 118, 120 of support body 70; and when swing units 110, 112 are positioned in their respective support seats formed by upper surface 84 and the inner surfaces of openings 80, 82 of body 70. Internally threaded swing arm receiving openings 160, 162 are formed respectively in swing units 110, 112 to receive threaded ends 40, 42 of swing arms 36, 38. The ends of swing units 110, 112 opposite ends 130, 132 thereof may be formed solid or if preferred openings 164, 166 with internal threads may be formed therein to receive externally threaded end caps 168, 170.

To assemble vertical support bracket 50 one need only place swing units 110, 112 with their ends 130, 132 extending respectively into openings 80, 82 of body 70. Threaded members 144, 146 are thereafter threaded into place so that their respective ends extend into grooves 134, 136 respectively of swing units 110, 112.

Vertical swing bracket 50 may thereafter have swing arms 36, 38 threaded into swing units 110, 112 if such has not been accomplished prior to installing swing units 110, 112 on bracket 70. In similar manner swivel assemblies 28, 30, swing arms 20, 22 and light sources 12, 14 may thereafter be connected to swing arms 36, 38; or that may be accomplished before swing arms 36, 38 are attached to vertical swing bracket 50. The fully assembled swing arm lamp 10 may thereafter be secured to support post 52 by threading threads 512 of support post 52 into threaded opening 96; unless that was accomplished as an earlier operation.

Each swing arm assembly, of the fully assembled lamp 10, can be rotated about the axis of rotation of its respective swing unit 110, 112 because the ends of threaded members 144, 146 will permit rotation of swing units 110, 112 but not removal thereof from vertical support bracket 50.

In FIG. 5 there is shown a pair of swing arms 200, 202 mounted to a vertical swing bracket 210 that is, in turn, disposed on top of a support post 212 which is connected to and extends up from a support base 214. The free ends 220, 222, respectively, of swing arms 200, 202 are fitted with swivel units of conventional construction and adapted to receive suitable light units (not shown). Swing arms 200, 202 are formed of tubular stock and into a bowed or arcuate configuration. Other appropriate configurations are contemplated as long as each swing arm can be connected at its other end 230, 232 to a respective swing unit 240, 242 carried by vertical swing bracket 210.

Figure 2:
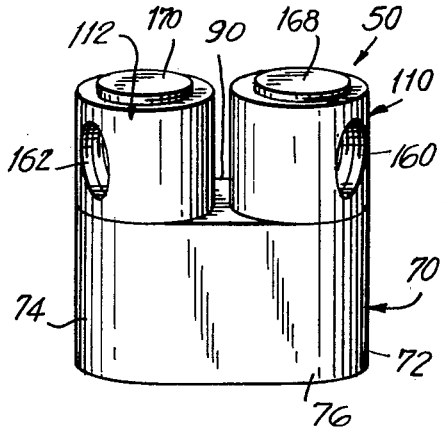
FIG. 2 is an enlarged perspective view of the vertical support bracket for the lamp of FIG. 1.
Figure 3:
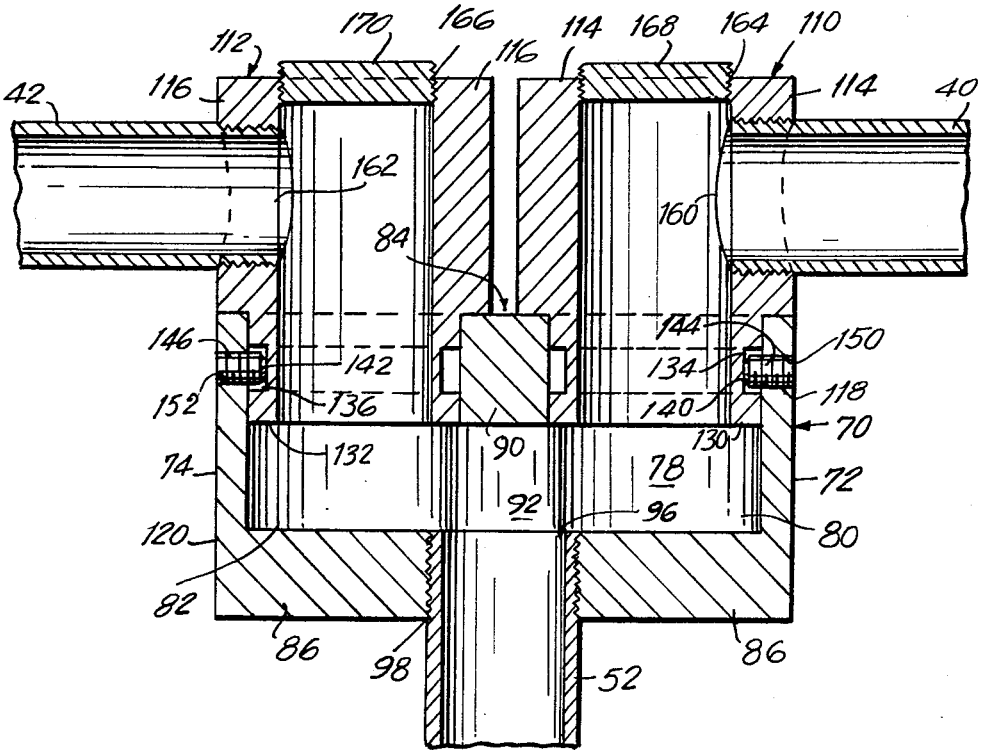
FIG. 3 is an enlarged sectional elevational view of the vertical support bracket with swing units of the swing arm lamp of FIG. 1.

Vertical swing bracket 210 is identical in construction to bracket 50 of the embodiment of FIGS. 2 and 3; however swing units 240, 242 differ slightly from swing units 110, 112 of the embodiment of FIGS. 2 and 3. Swing units 240, 242 are formed without swing arm receiving openings through their respective tubular side walls but instead have internally threaded swing arm receiving openings formed in their upper end walls. Except for the above described differences swing units 240, 242 are identical to swing units 110, 112.

In FIG. 6 there is shown a pair of swing arms 250, 252 mounted to a vertical swing bracket 260 that is, in turn, disposed on top of a support post 262 which is connected to and extends from a wall bracket 264. The free ends 270, 272, respectively, of swing arms 250, 252 are fitted with swivel units of conventional construction and adapted to receive suitable light units (not shown). Swing arms 250, 252 are formed of tubular stock and are connected at their other ends 270, 272 to swing units 274, 276 respectively carried by vertical swing bracket 260.

Vertical swing bracket 260 and swing units 270, 272 are identical in construction and operation to vertical swing bracket 50 and swing units 110, 112 of FIG. 3.

In FIG. 7 there is shown a pair of swing arms 300, 302 mounted to a vertical swing bracket 310 that is, in turn, disposed on top of a support post 312 which is connected to and extends up from a support base 314. The free ends 320, 322, respectively, of swing arms 300, 302 are fitted with swivel units of conventional construction and adapted to receive suitable light units (not shown). Swing arms 300, 302 are formed of tubular stock and into the curved configuration shown. Any other suitable curved configuration can be utilized.

The other ends of swing arms 300, 302 are connected to swing units 326, 328 carried by vertical swing bracket 310.

Vertical swing bracket 310 is identical in construction to bracket 50 of the embodiment of FIGS. 2 and 3; however, swing units 326, 328 are of a different external configuration than swing units 110,112 of FIGS. 2 and 3, and swing units 326, 328 receive their respective swing arms at an angle with respect to the axis of rotation of swing units 326, 328 rather than along an axis perpendicular to or co-axial with said axis of rotation. Except for the above described differences swing units 326, 328 are identical to swing units 110, 112.

From the above description it will thus be seen that there has been provided novel and improved swing arm lamps, and novel and improved vertical swing brackets therefore; which provide simple and efficient support for the swing arms of said swing arm lamps.

It is my understanding that although I have shown the preferred form of my invention that various modifications may be made in the details thereof without departing from the spirit as comprehended by the following claims.

In addition, it thus will be seen that there is provided a vertical swing bracket which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention.

I claim:

1. A swing arm assembly for a lamp; comprising:

(a) swing arm means for supporting a light source;

(b) at least one swing unit means connected to said swing arm means and including a swing unit mounting portion substantially cylindrical in external configuration;

(c) vertical swing bracket means coacting with said swing arm means to mount same for rotation about a predetermined vertical axis of rotation;

(d) said vertical swing bracket means including at least one swing unit mounting seat sized and arranged to receive said swing unit mounting portion and to facilitate rotation of said swing unit means about said predetermined axis of rotation;

(e) said mounting portion of said swing unit means further including a circular groove formed in its external cylindrical surface;

(f) said mounting seat including retention means selectively movable between a first position wherein a portion of said retention means extends into said circular groove of said swing unit means and prevents movement of said swing unit means along said predetermined axis of rotation while not hindering rotation thereof about said predetermined axis of rotation, and a second position removed from said circular groove to permit movement of said swing unit means in a direction along said predetermined axis of rotation;

(g) said vertical swing bracket means further including mounting means to facilitate mounting same, said swing unit means, said swing arm means and any light source supported thereby.

2. The swing arm assembly of claim 1; wherein:

(a) said swing unit means includes a pair of swing units, each including a swing unit mounting portion substantially cylindrical in external configuration with a circular groove formed in the surface thereof; and (b) said vertical swing bracket means includes a pair of swing unit mounting seats spaced one from the other but aligned so that there are two parallel and spaced axes of rotation one for each of said swing units, and a pair of said retention means one disposed for coaction with each of said circular grooves;

(c) said swing arm means includes a pair of swing arms; and (d) said swing units each being connected to one of said swing arms.

3. The swing arm assembly of claim 2: wherein each of said swing units is substantially tubular in configuration.

4. The swing arm assembly of claim 3: wherein each swing arm is substantially tubular in configuration and is connected to its respective swing unit along an axis that extends through the cylindrical tubular surface and is perpendicular to said predetermined axis of rotation of its respective swing unit.

5. The swing arm assembly of claim 2: wherein each swing arm is formed from tubular stock and into an arcuate configuration and an end of each of said swing arms is connected to its respective swing unit to be co-axial with the tubular end of its respective swing unit and its predetermined axis of rotation.

6. The swing arm assembly of claim 1: wherein said swing unit means is substantially tubular in configuration.

7. The swing arm assembly of claim 6: wherein said swing arm means is substantially tubular in configuration and is connected to said swing unit means along an axis that extends through the cylindrical tubular surface and is perpendicular to said predetermined axis of rotation.

8. The swing arm assembly of claim 6: wherein said swing arm means is formed from tubular stock and into an arcuate configuration and wherein a tubular end of said swing arm means is connected to said swing unit means so as to be co-axial with said predetermined axis of rotation.

9. The swing arm assembly of claim 1: wherein said vertical swing bracket means is substantially oval in horizontal cross section with semi-circular ends and parallel sides.

10. The swing arm assembly of claim 9: wherein said swing unit mounting seat includes a cylindrical opening extending down from an upper surface of said swing unit mounting seat to terminate within sad vertical swing bracket means, and comprises an upper surface of said vertical swing bracket means and a portion of the inner surface of said cylindrical opening near the upper extremity thereof.

11. The swing arm assembly of claim 10: wherein there are two swing unit mounting seats formed in said vertical swing bracket with the centerline axis of one cylindrical opening spaced and parallel to that of the other.

12. A vertical swing bracket for a swing arm lamp; comprising:

(a) swing unit means to be connected to the swing arm means for a swing arm lamp and including a swing unit mounting portion substantially cylindrical in external configuration;

(b) bracket means coacting with said swing unit means to mount same for rotation about a predetermined axis of rotation;

(c) said bracket means including at least one swing unit mounting seat sized and arranged to receive said swing unit mounting portion and to facilitate rotation of said swing unit means about said predetermined axis of rotation;

(d) said mounting portion of said swing unit means further including a circular groove formed in its external cylindrical surface;

(e) said bracket means including retention means selectively movable between a first position wherein a portion of said retention means extends into said circular groove of said swing unit means and prevents movement of said swing unit means along said predetermined axis of rotation while not hindering rotation thereof about said predetermined axis of rotation, and a second position removed from said circular groove to permit movement of said swing unit means in a direction along said predetermined axis of rotation;

(f) said bracket means further including bracket mounting means to facilitate mounting said bracket means, swing unit means and any light source to be supported thereby.

13. The swing arm support unit of claim 12; wherein:

(a) said swing unit means includes a pair of swing units, each including a swing unit mounting portion substantially cylindrical in external configuration with a circular groove formed in the surface thereof; and (b) said bracket means including a pair of swing unit mounting seats spaced one from the other but aligned so that there are two parallel and spaced axes of rotation one for each of said swing units, and a pair of said retention means one disposed for coaction with each of said circular grooves.

14. The swing arm support unit of claim 13: wherein each of said swing units is substantially tubular in configuration.

15. The vertical swing bracket of claim 12: wherein said bracket means is substantially oval in horizontal cross section with semi-circular ends and parallel sides.

16. The vertical swing bracket of claim 15: wherein said swing unit mounting seat includes a cylindrical opening extending down from an upper surface of said swing unit mounting seat to terminate within said bracket means, and comprises an upper surface of said vertical swing bracket means and a portion of the inner surface of said cylindrical opening near the upper extremity thereof.

17. The vertical swing bracket of claim 16: wherein there are two swing unit mounting seats formed in said bracket means with the centerline axis of one cylindrical opening spaced and parallel to that of the other.

* * * * *